US007854559B2

(12) United States Patent
Liu

(10) Patent No.: US 7,854,559 B2
(45) Date of Patent: Dec. 21, 2010

(54) PEN WITH DOUBLE PEN BARREL

(75) Inventor: Yu-Yin Liu, Taipei (TW)

(73) Assignee: Spark Gold Co., Taipei (TW)

( * ) Notice: Subject to any disclaimer, the term of this patent is extended or adjusted under 35 U.S.C. 154(b) by 99 days.

(21) Appl. No.: 12/412,994

(22) Filed: Mar. 27, 2009

(65) Prior Publication Data

US 2010/0166487 A1 Jul. 1, 2010

(30) Foreign Application Priority Data

Dec. 26, 2008 (TW) ..... 97151137 A

(51) Int. Cl.
*B43K 27/00* (2006.01)

(52) U.S. Cl. ..... 401/31; 401/99; 401/111; 401/114

(58) Field of Classification Search ..... 401/29–35, 401/65, 66, 99, 109–115
See application file for complete search history.

(56) References Cited

U.S. PATENT DOCUMENTS 2,446,044 A * 7/1948 Davis ..... 401/62
2,483,329 A * 9/1949 Wahl ..... 401/113
3,837,748 A * 9/1974 Wada ..... 401/30

FOREIGN PATENT DOCUMENTS

| | | |
|---|---|---|
| TW | 579951 | 3/2004 |
| TW | M250815 | 11/2004 |
| TW | M344256 | 11/2008 |

* cited by examiner

*Primary Examiner*—Gregory L Huson
*Assistant Examiner*—Keegan Gumbs
(74) *Attorney, Agent, or Firm*—Muncy, Geissler, Olds & Lowe, PLLC

(57) ABSTRACT

A pen with double pen barrels is revealed. The pen with double pen barrels includes two pen barrels connected in parallel, a pen refill in each pen barrel, and a driving member disposed between the two pen barrels. When one of the pen barrels is pressed and moved downward, a pen refill extends out of a front end of the pen barrel, located to be in writing state. Then by releasing a stopper of the pen barrel, the pen barrel moves upward and the pen refill retracts to be in storage state. Thus the pen barrel and the pen refill extends and contracts synchronously. Moreover, interests in use of the pen are increased.

6 Claims, 3 Drawing Sheets

PEN WITH DOUBLE PEN BARREL

BACKGROUND OF THE INVENTION

The present invention relates to a pen with double pen barrels, especially to a pen that includes two pen barrels arranged in parallel and integrated with each other to move slidingly so that a pen refill disposed in each pen barrel extends and retracts along with the pen barrel synchronously.

The pen has become one of portables that people carry with them everyday. Besides writing function, users also consider the novelty or interests of the pens while purchasing pens. There are various designs of mechanisms and operation ways of extension/retraction of pen refills, working as writing instruments. A common way is by pressing to extend a pen refill, as disclosed in Taiwanese patent M344256 and M250815. A click member that is able to turn back to original position elastically is disposed on top of the pen barrel. By pressing or releasing the click member, the pen refill is extended to be in writing state or is retracted into the pen barrel. Or the pen is operated by a rotation way, as revealed in Taiwanese patent No. 579951. By male and female threads of an inner pen barrel and an outer pen barrel, the outer pen barrel is rotated clockwise or counterclockwise so as to drive the inner pen barrel and the pen refill therein extending/retracting. However, the pen barrel of most of the pens is a single tube, without any special design. Moreover, the operation ways are also similar. Thus requirement of constant innovation of users is unable to be satisfied.

SUMMARY OF THE INVENTION

Therefore it is a primary object of the present invention to provide a pen with double pen barrels that includes two pen barrels, a driving member, two pen refills and two elastic members. The driving member is enclosed in and is disposed between the two pen barrels. Thus the two pen barrels are connected in parallel and, are slidable to each other and are integrated with each other by the driving member. When one of the pen barrels is pressed to move downward, the pen refill in the pen barrel synchronously extends out of the bottom of the pen barrel, being located to be in writing state. When a stopper of the pen barrel is released, the pen barrel moves upward by elastic recovery force of a elastic member and the pen refill turns back to the original position, in storage state. The two pen refills in the two pen barrels retract along with the upward/downward sliding of the two pen barrels so that both the pen refills are in storage state. Moreover, one of the pen refills retracts to a storage state while the other pen refill extends into a writing state, or both two pen refills extends out of the pen barrels, ready to write. There are several modes of use. The operation of the pen is improved and the interests in use are increased.

In order to achieve above object, a pen of the present invention includes two pen barrels slidingly arranged on left and right sides of a driving member in parallel. A click member disposed on top of each pen barrel is connected with a toothed wheel member of the driving member. The driving member consists of a frame, two toothed wheel members and two moveable members. The frame includes two projecting rods arranged on top thereof and obliquely corresponding to each other, a longitudinal long slot arranged on an upper part thereof, two opposite toothed parts respectively disposed on edges of the front side and the back side thereof, two opposite stoppers respectively under the long slot and on the front side and the back side, and a plurality of corresponding projecting plates arranged on a lower part thereof for being assembled with the long slot of the pen barrel. The toothed wheel members are respectively disposed on the front side and the back side of the frame, beside the long slot. One end (an inner end) of a central shaft of the toothed wheel member is restricted to move longitudinally inside the long slot of the frame. The other end of the central shaft is assembled with the bottom end of a click member and is moved along with the click member synchronously. The two moveable members are disposed on the front side and the back side of the frame. The moveable member consists of a longitudinal toothed part arranged on the upper end, corresponding to and engaged with the toothed wheel member, a stopping part disposed under the toothed part for being locked with a stopper of the frame and a connection part arranged on the bottom end for connecting with a pen refill so that the pen refill moves upward/downward along with the moveable member. The two elastic members are respectively assembled with a projecting rod on top of the frame and are mounted in the space of the click member. Thereby, when one of the click members is pressed, the click member drives a pen barrel and a toothed wheel member on the frame of the driving member to move downward. At the same time, by the movement between the toothed wheel member and the toothed part of the moveable member, the pen refill is driven by the toothed wheel member to move downward. When the stopping part locks with the stopper of the frame, the pen refill extends out of the pen barrel and is located, ready to write things. When the stopper is actuated for being released from the stopping part, the pen barrel moves upward by elastic recovery force of the elastic member and simultaneously the pen refill retracts to be in storage state. Thus the pen barrel and the pen refill retract synchronously.

DETAILED DESCRIPTION OF THE PREFERRED EMBODIMENT

Figure 1:
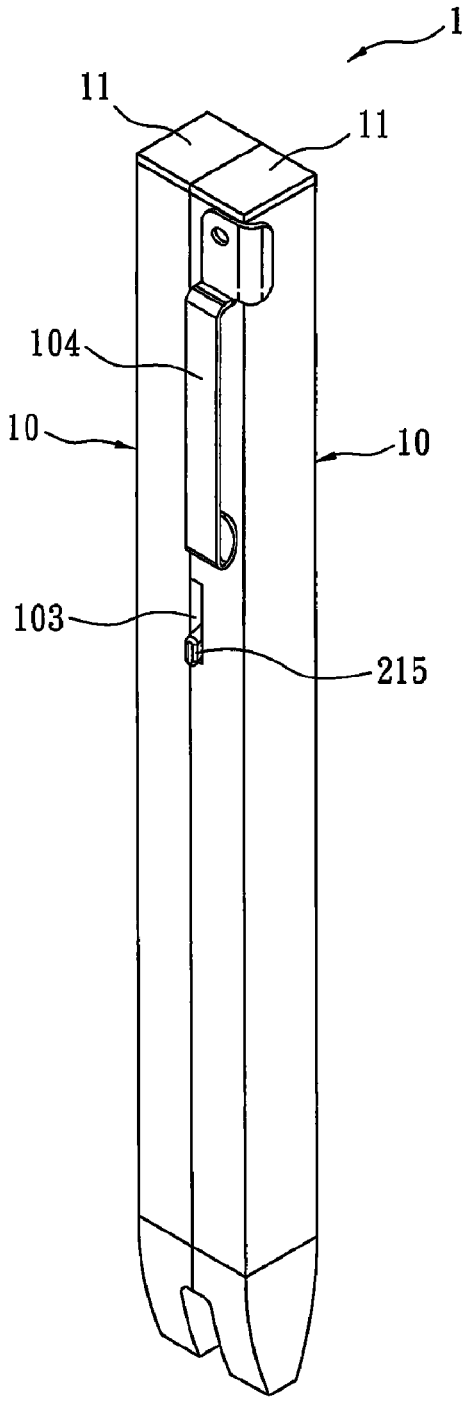
FIG. 1 is a perspective view of an embodiment of a pen while a pen refill is retracted.
Figure 2:
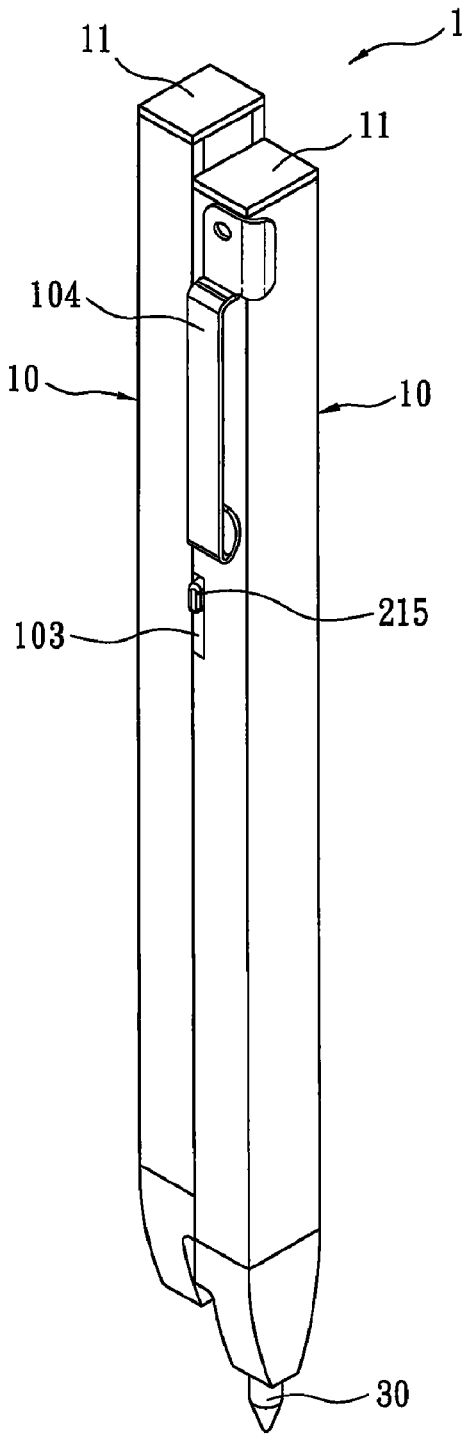
FIG. 2 is a perspective view of the embodiment while the pen refill is extended.
Figure 3:
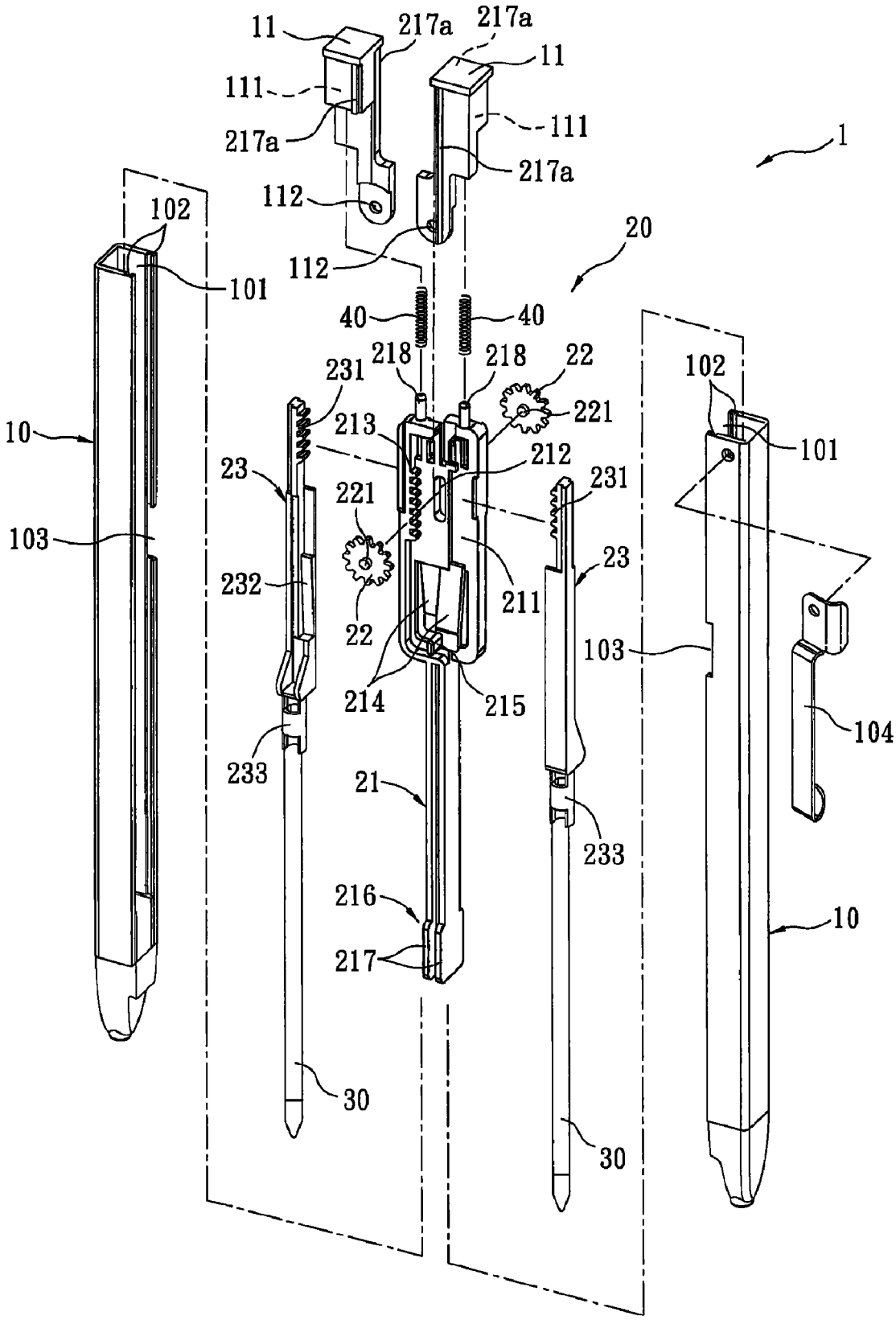
FIG. 3 is an explosive view of the embodiment.

Refer from FIG. 1 to FIG. 3, a pen 1 with double pen barrels according to the present invention consists of two pen barrels 10, a driving member 20, two pen refills 30 and two elastic members 40. The pen barrel 10 includes an opening side 101. Two opposite sides on inner sides of the pen barrel 10, beside the opening side 101 are respectively disposed with a long slot 102 for being assembled with two projecting plates 217 arranged parallel on two frames 21 of the driving member 20 slidingly. Thus by the opening sides 101, the two pen barrels 10 are connected with each other and arranged in parallel to form an integrated pen 1. The pen barrels 10 are able to move upward and downward slidingly. A click member 11 for being pressed is disposed on top of the pen barrel 10. The click member 11 is arranged with a space 111 for loading an elastic member 40. A through hole 112 is arranged on bottom of the click member 11 for being inserted by a central shaft 221 of a toothed wheel 22 of the driving member 20. Moreover, at least one projecting plate 217*a* that is assembled with the long slot 102 of the pen barrel 10 is disposed on one side of the click member 11 for increasing stability of assembling and upward/downward movement. A rectangular opening 103 is arranged on the appropriate position beside the opening side 101 of the pen barrel 10. The shape of the cross section of the two pen barrels is not limited and it can be C-shaped as shown in this embodiment or others such as V-shaped, U-shaped, semicircular or polygonal (not shown in figures). Furthermore, a pen clip 104 is set on one side of the upper part of the pen barrel 10.

The driving member 20 includes a frame 21, two toothed wheel members 22 and two moveable members 23. The frame 21 consists of two projecting rods 218 arranged on top thereof and obliquely corresponding to each other, a longitudinal long slot 212 arranged on an upper part 211, two opposite toothed parts 213 respectively disposed on edges of the front side and the back side thereof, two opposite stoppers 214 respectively under the long slot 212 and on the front side and the back side, and a plurality of corresponding projecting plates 217 arranged on a lower part 216 for being assembled with the long slot 102 of the pen barrel 10. A rod 215 is arranged projectingly on a bottom end of the stopper 214 and the rod 215 inserts through the rectangular opening 103 of the pen barrel 10. As to the toothed wheel members 22, they are respectively disposed on the front side and the back side of the frame 21, beside the long slot 212 and each has a central shaft 221. One end (an inner end) of the central shaft 221 is restricted to move longitudinally inside the long slot 212 of the frame 21. The other end of the central shaft 221 is assembled with the through hole 112 on the bottom end of the click member 11 and is moved along with the click member 11 synchronously. The two moveable members 23 are disposed on the front side and the back side of the frame 21. The moveable member 23 consists of a toothed part 231 arranged on the upper end, corresponding to and engaged with the toothed wheel member 22, a stopping part 232 disposed under the toothed part 231 for being locked with the stopper 214 of the frame 21 and a connection part 233 arranged on the bottom end for connecting with the pen refill 30.

The two pen refills 30 are respectively disposed inside the two pen barrels 10 and are connected with the bottom end of the two moveable members 23 of the driving member 20. By upward and downward movement of the moveable member 23, the pen refill 30 is driven to move upward/downward. The type of the pen refill 30 is not restricted and it can be a pencil refill, a ballpoint pen refill, or a stylus. Moreover, the pen refill 30 can be formed and integrated together with the moveable member 23 while being produced, such as in an embodiment of a stylus.

The two elastic members 40 are assembled with two projecting rods 218 arranged on top of the frame 21. The top end of the elastic member 40 is mounted in the space 111 of the click member 11 so that the elastic member 40 is to be compressed while being pressed by the click member 11. Furthermore, the two elastic members 40 can be springs or leaf spring.

Figure 4:
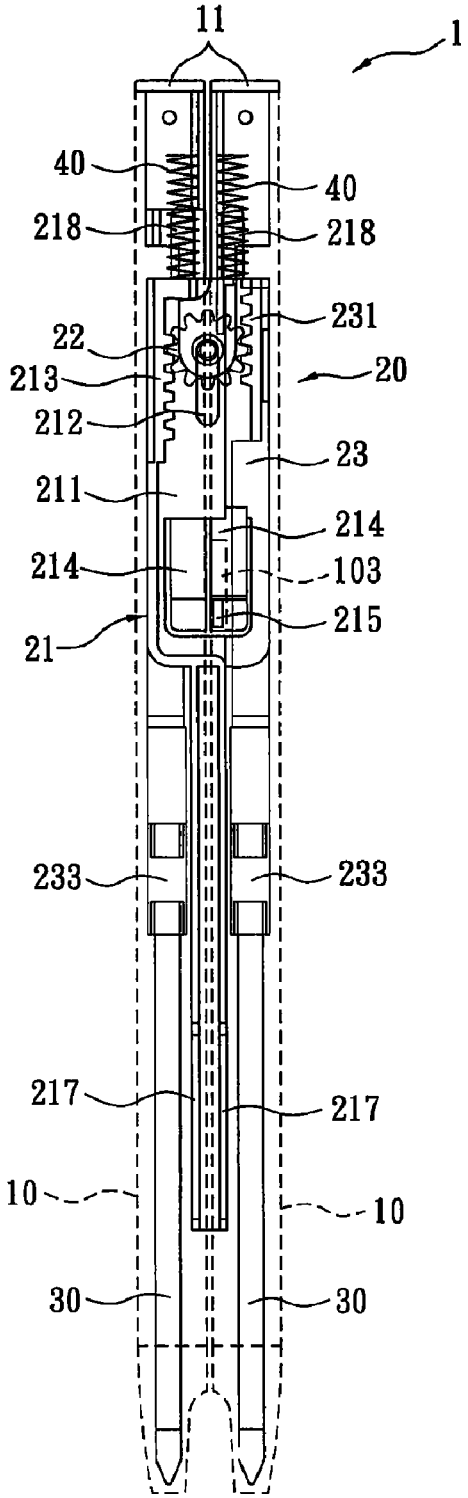
FIG. 4 is a cross sectional view of the embodiment.
Figure 5:
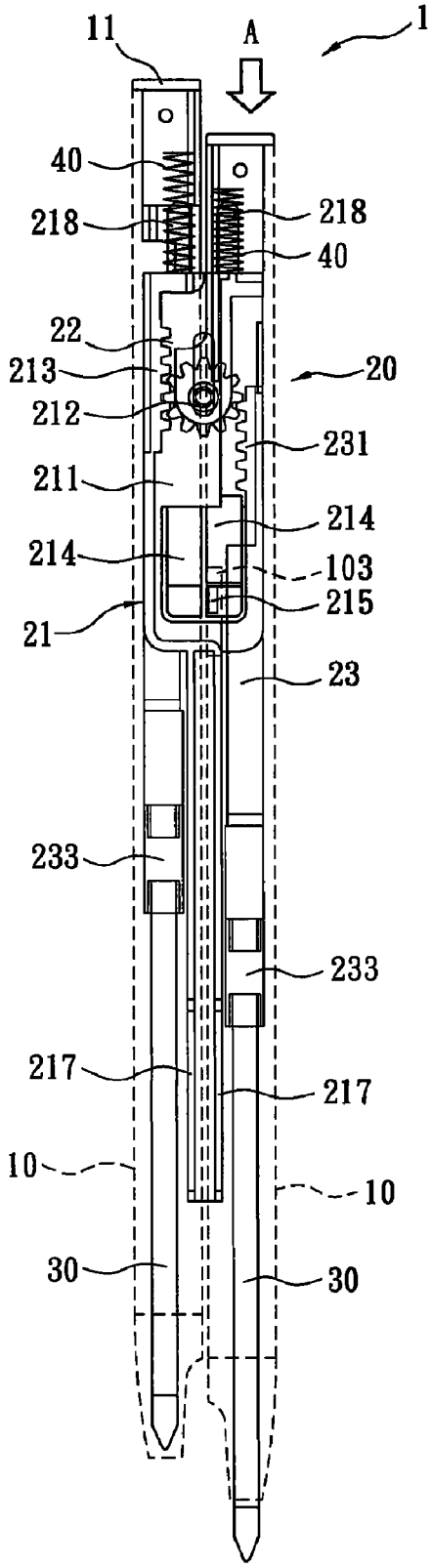
FIG. 5 is a cross sectional view of the embodiment.

Refer to FIG. 4 & FIG. 5, the movement among the moveable member 23 arranged on the front side of the frame 21, the toothed wheel member 22 and the toothed part 213 is disclosed. The movement of the other moveable member 23 on the back side of the frame 21 is similar to the moveable member 23 on the front end, shown in FIG. 4 & FIG. 5. As an arrow A in FIG. 5, when the click member 11 is pressed, the click member 11 drives the pen barrel 10 to move downward synchronously. At the same time, the elastic member 40 is compressed to be in a pressed state and the toothed wheel member 22 is driven to move downward along the longitudinal long slot 212. By the movement between the toothed wheel member 22 and the toothed part 213, the toothed wheel member 22 rotates and moves downward. By the movement between the toothed wheel member 22 and the toothed part 231 of the moveable member 23, the moveable member 23 and the pen refill 30 on the bottom end thereof are driven to move downward synchronously. Thus the stopping part 232 of the moveable member 23 locks with the stopper 214 of the frame 21 and the pen refill 30 extends out of the bottom of the pen barrel 10 and is located, ready to write things, as shown in FIG. 5. When the stopper 214 is actuated for being released from the stopping part 232, the pen barrel 10 and the pen refill 30 are retracted back to the original positions and in storage state by elastic recovery force of the elastic member 40, as shown in FIG. 4.

In addition, when the pen refill 30 of one of the pen barrels 10 extends outward, being located to be in writing state, as shown in FIG. 5, the other pen barrel 10 can also be pressed in the same way so as to make the pen refill 30 of the other pen barrel 10 also extend forward and being located to be in writing state. Thus the pen with double pen barrels according to the present invention can be in a status that both two pen refills are retracted into storage state, in a state that one pen refill retracts while the other pen refill extends to write, or in a state that both two pen refills are extended. Therefore, the operation of the pen is improved and the interests in use are increased.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A pen with double pen barrels comprising:

two pen barrels that each having an opening side and two opposite sides that are beside the opening side and respectively disposed with a long slot for being assembled with two projecting plates arranged parallel of two parallel frames on a left side and a right side of a driving member so that the two pen barrels integrate with each other and slide upward and downward relatively; a click member disposed on top of each pen barrel while each pen barrel further includes a rectangular opening;

a driving member having a frame, two toothed wheel members and two moveable members; wherein the frame includes a longitudinal long slot arranged on an upper part, two opposite toothed parts respectively disposed on edges of a front side and a back side thereof, two opposite stoppers respectively set under the long slot and on the front side and the back side, and a plurality of corresponding projecting plates arranged on a lower part for being assembled with the long slot of the pen barrel; the two toothed wheel members are respectively disposed on the front side and the back side of the frame, beside the long slot and each has a central shaft in which one end thereof is restricted to move upward and downward inside the longitudinal long slot of the frame while the other end of the central shaft is attached on the click member and is moved along with the click member synchronously; the two moveable members disposed on the front side and the back side of the frame, inside the two pen barrels and each moveable member having a toothed part arranged on an upper end, corresponding to and engaged with the toothed wheel member, a stopping part disposed under the toothed part for being locked with a stopper of the frame and a connection part arranged on the bottom end for connecting with a pen refill;

two pen refills respectively disposed in the two pen barrels and connected with a bottom end of the moveable member of the driving member so as to move upward and downward along with the moveable member synchronously;

two elastic members each supported between the frame and the click member;

wherein when one of the click members is pressed, the click member drives the pen barrel to move downward so that the elastic member is compressed simultaneously and the toothed wheel member of the driving member is driven to move downward along the longitudinal long slot of the frame synchronously while the moveable member with the pen refill are also driven to move downward at the same time; when the stopping part of the moveable member locks with the stopper of the frame, the pen refill extends out of the pen barrel, being located to be in writing state; when the stopper is actuated and released from the stopping part, the pen barrel and the pen refill retract upward by elastic recovery force of the elastic member so that the pen refill retracts to be in storage state simultaneously while the pen barrel moves upward.

2. The device as claimed in claim 1, wherein a shape of a cross section of the pen barrel is C-shaped, V-shaped, U-shaped, or semicircular.

3. The device as claimed in claim 1, wherein a side of the click member is further disposed with projecting plates for being assembled with the long slot of the pen barrel so as to make the click member move upward and downward stably.

4. The device as claimed in claim 1, wherein two projecting rods are arranged on top of the frame and obliquely corresponding to each other.

5. The device as claimed in claim 1, wherein a rod is arranged projectingly on a bottom end of the stopper and the rod inserts through the rectangular opening of the pen barrel.

6. The device as claimed in claim 1, wherein the pen refill is a pencil refill, a ballpoint pen refill or a stylus.

* * * * *